United States Patent [19]

Clinnin et al.

[11] Patent Number: 4,781,378

[45] **Date of Patent: * Nov. 1, 1988**

[54] PROMOTIONAL GAME

[75] Inventors: John V. Clinnin, Nokomis, Fla.; Dale E. Dolence, Carbondale, Ill.

[73] Assignee: Lustour Corp., Murphysboro, Ill.

[ * ] Notice: The portion of the term of this patent subsequent to Oct. 4, 2005 has been disclaimed.

[21] Appl. No.: 76,322

[22] Filed: Jul. 22, 1987

[51] Int. Cl.[4] ..... A63F 1/00

[52] U.S. Cl. ..... 273/138 R; 273/270; 283/79

[58] Field of Search ..... 273/148 R, 139, 287, 273/293, 138 R, 269, 270; 206/459; 283/72, 79; 428/515

[56] References Cited

U.S. PATENT DOCUMENTS

| | | | |
|---|---|---|---|
| 3,249,286 | 5/1966 | Palmer | 229/55 |
| 3,603,592 | 9/1971 | Bury | 273/269 |
| 4,332,325 | 6/1982 | Manizza | 206/459 |
| 4,440,824 | 4/1984 | Bonis | 428/216 |
| 4,509,759 | 4/1985 | Small | 273/269 |
| 4,551,373 | 11/1985 | Conlon | 283/79 X |
| 4,657,803 | 4/1987 | Pernicano | 428/200 |

FOREIGN PATENT DOCUMENTS

| | | | |
|---|---|---|---|
| 0048961 | 4/1982 | European Pat. Off. | 273/139 |
| 2561116 | 9/1985 | France | 273/148 R |
| 2572298 | 5/1986 | France | 273/148 R |

*Primary Examiner*—Carlton R. Croyle
*Assistant Examiner*—Theodore Olds
*Attorney, Agent, or Firm*—Mann, McWilliams, Zummer & Sweeney

[57] ABSTRACT

A promotional game particularly adapted for use in connection with packaged food products, the game including a game board preferably printed on the product container and one or more game cards. The game board has imprinted on it a first set of game indicia which is common to all packages utilized in the promotion. The game card consists of a transparent film laminate on which is imprinted a second set of game indicia, which will vary from card to card. The card consists of a film laminate including a transparent core layer of biaxially oriented polymeric film on which is printed the second set of game indicia, which is then coated with adhesive, and laminated with a layer of transparent, grease and oil resistant, polymeric film. The game is played by removing the card or cards from the package and placing it in overlying register with the game board to determine whether that combination is a game winner.

7 Claims, 1 Drawing Sheet

PROMOTIONAL GAME

BACKGROUND OF THE INVENTION

Numerous games have been provided which utilize one transparent element disposed over an underlying game board. See, for example, U.S. Pat. Nos. 4,285,520, 4,509,759, 4,577,869, and 4,619,457. Other apparatus have been provided utilizing a background card and a transparent overlay. In this regard, see U.S. Pat. Nos. 3,402,694 and 3,603,592. None of these arrangements, however, have specifically addressed the need for a promotional game which is particularly adapted for use in connection with the sale of packaged food products. Special problems exist when a game card is to be placed in a package containing food wherein the card will come in contact with the food product. It is essential that the printing on the card be protected from contact with oils or other liquids which may emanate from the food product. The United States Food and Drug Administration allows only a small number of vegetable-based inks to be used in materials that are in direct contact with food. In addition to protecting the printing ink on the game card, the food product must also be protected from ink or odor contamination coming from the game card. None of the prior art game arrangements have considered or addressed this problem.

SUMMARY OF THE INVENTION

The present invention provides a promotional game which includes a game board printed with a fixed set of game indicia. The game further includes one or more game cards which are specially constructed such that the printing on the card is protected against contact with the packaged food product. The card is a film laminate consisting of a transparent core layer of polymeric film printed with a second and variable set of game indicia designed to correspond with the indicia printed on the game board. The printed core layer is then covered with a layer of adhesive which, in turn, is coated, on one or both sides, with a layer of transparent, grease and moisture resistant, polymeric film which seals the printing from contact with food oils. The game is played by removing the specially constructed game card from the package and placing it in overlying register with game board such that the combination of game card and game board will immediately indicate whether it is a winning combination. Alternatively, for continuity type games, a plurality of game cards are placed in register with each other overlying the game board.

DETAILED DESCRIPTION

Figure 1:
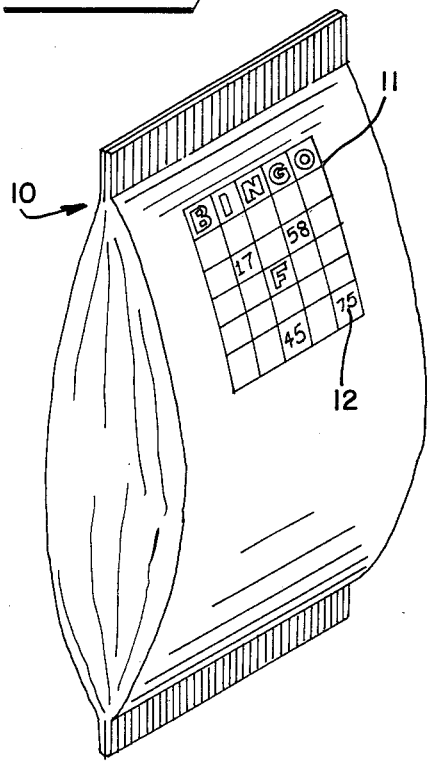
FIG. 1 is a perspective view showing a package on which is imprinted a game board of the present invention.

FIG. 1 illustrates a package 10 on which is imprinted a game board 11 consisting of a standard Bingo board well known to all. The game board 11 includes five vertical rows and five horizontal rows of squares. A first set of game indicia 12 is printed within certain of the squares, as, for example, the number 17 appearing under the vertical row "I", the number 45 appearing in the vertical row under "N", the number 58 appearing under the vertical row "G", and the number 75 appearing under the vertical row "O". Additionally, the center square bears the designation "F", indicating that this is a "free" square utilizable to make vertical rows, horizontal rows, or diagonal rows in order to provide a winning combination. The game board 11 is preferably printed on the exterior of the package with ink that is not susceptible to flaking or peeling. Preferably, the package also contains all of the rules and other information necessary for playing the game and for redemption of awards. It is the intention that all game boards will be identical in configuration and contents. The package 10 is sealed at both ends and contains food or any other product which the promoter wishes to furnish.

Figure 2:
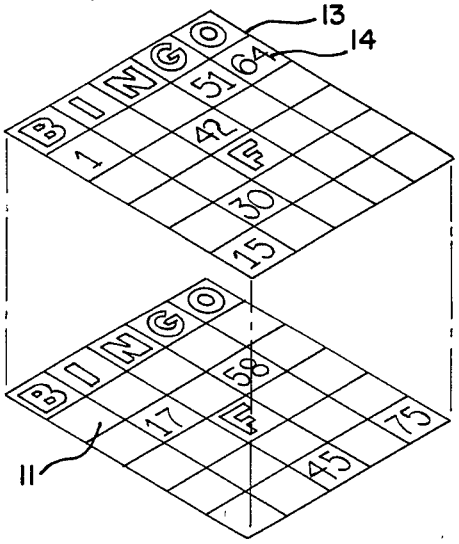
FIG. 2 is a perspective view showing the game card of the present invention in overlying relationship with the game board.
Figure 4:
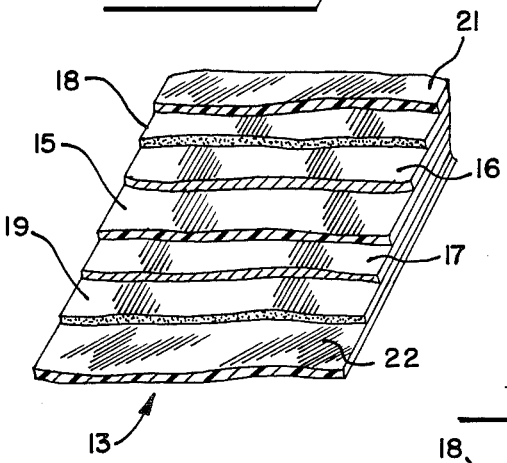
FIG. 4 is a perspective view partially broken away showing one embodiment of the game card.
Figure 5:
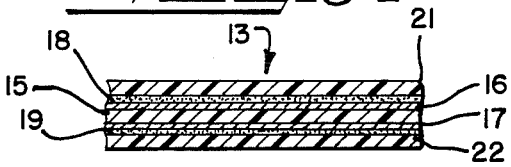
FIG. 5 is a side view showing the various elements of the film laminate shown in FIG. 4.

Included within the package is a specially designed game card, illustrated in FIG. 2 as 13. The game card 13 is identical in size, shape, and configuration as the game board 11 and includes a second set of game indicia 14 such as, for example, the numbers 1, 15, 30, 42, 51, and 64, which appear on the face of the insert 13 shown in FIG. 2. The structure of one embodiment of the game card 13 is illustrated in FIGS. 4 and 5 and may be similar to that disclosed in applicant's copending application Ser. No. 036,388, filed Apr. 9, 1987. This embodiment includes a central core layer 15 of transparent biaxially oriented polymeric film. The core layer 15 of this embodiment is a clear three mil polystyrene, but any biaxially oriented, transparent, polymeric film that can receive printing inks may be used. Polystyrene is preferred because of its ability to produce high quality graphics when printed, offering a variety of printing capabilities.

The relative thickness of the composite layers of the laminate of this invention may, of course, vary within the limits which will be recognized by those skilled in the art.

In the embodiment of FIG. 4, the core layer 15 is then printed on one or both sides, as illustrated at 16 and 17. The printing includes the second set of game indicia 14 illustrated in FIG. 2. Every game board 11 is printed with the "free" space in the middle and four other numbers. The positioning of numbers on the game card 13 is in spaces other than those already used on the game board. Hence, when the game card is overlayed on the game board, a total of ten numbered squares and one "free" square are visible. The combination of these eleven occupied squares will result in the following Bingo possibilities:

(a) five different horizontal positions;

(b) five different vertical positions;

(c) two different diagonal positions;

(c) any other format, such as four corner Bingo which the promoter wishes to designate; The number of winning cards available is directly controllable by the number of these combinations printed. The randomization of losing cards is limited only to the extent of conceived need.

The methods of printing which have been found suitable include rotogravure printing and flexographic process printing. Other printing techniques may also be utilized. The variety of inks which may be used is wide in scope since the net effect of the laminated insert is to prevent contact between the ink and the food product. One ink which has been found to be effective is one sold by American Inks and Coatings and designated as opticite type ink R-22811-Fl. The core layer 15 may be printed on either side or possibly on both sides.

For purposes of explanation, it will be assumed that the embodiment of FIG. 4 has a central core layer 15 with game indicia printed on both sides at 16 and 17. Each layer of printing is then coated on its exterior surface by a layer of adhesive illustrated in FIGS. 4 and 5 as layers 18 and 19, respectively. This is preferably accomplished during an in-line adhesive lamination process. Adhesives which have been found to be acceptable in formulating the insert of the present invention include a two-component solvent base urethane prepolymer adhesive which is a mixture of Lamal HSA and Catalyst C in proportions as specified by the manufacturer. A two-component, water-borne adhesive has also been used consisting of a mixture of Morton Chemical Company Adcote 77T660 and Adcote 9T5, again in proportions as specified by the manufacturer. For hand lamination, a pressure-sensitive adhesive sold by Morton Chemical Company under the designation Adcote 333 has also been used.

Next, outer layers 21 and 22 are laminated over the layers 18 and 19, respectively. The outer layers 21 and 22 consist of any of a variety of transparent, grease and moisture resistant, polymeric films. One such film which has been utilized successfully in the practice of the present invention is a biaxially oriented polypropylene sold by Curwood, Inc. under the trademark CURPHANE 703. Depending on the need for stiffness and thickness, a transparent, grease-resistant, biaxially oriented polystyrene may be used for the outer layers 21 and 22. Use of polystyrene for these layers substantially stiffens the game card. One such polystyrene which has been found to be acceptable is sold by Dow Chemical Company under the designation "clear opticite" XU65021.02.

The manufacture of the game card disclosed herein and illustrated in FIGS. 4 and 5 is preferably accomplished by an adhesive lamination of the composite sheet. Use of oriented polypropylene in the outer layers 21 and 22 provides a clear, protective covering for the inks and core layer. Use of clear, biaxially oriented polystyrene for these layers offers a stiffer finished structure. The outside layers of grease-resistant film can vary in thickness. In general, acceptable thicknesses range between 0.5 mil and 4 mils in thickness. The core layer is preferably transparent polystyrene.

Certain preferred embodiments of this invention and methods of making the laminate are illustrated in the following specific examples:

No. 1. A central core layer of 3 mil clear polystyrene was rotogravure printed, both sides in register, with American Inks and Coatings opticite type ink R-22811-Fl. This structure was then in-line adhesive laminated on both sides to an outer layer of 50GA oriented polypropylene, Curwood, CURPHANE 703, with a layer of adhesive designated as Morton Chemical Company Adcote 77T660 and Adcote 9T5.

No. 2. A central core layer of 3 mil clear polystyrene was rotogravure printed, both sides in register, with American Inks and Coatings opticite type ink R-22811-F1. This structure was then in-line adhesive laminated on both sides to an outer layer of 50 GA oriented polypropylene, Curwood, CURPHANE 703, with a layer of adhesive designated as Morton Chemical Company Lamal HSA and Catalyst C.

No. 3. A number of samples were also hand laminated utilizing a central core layer of 3 mil clear polystyrene printed on both sides with the same ink as set forth in Examples 1 and 2, and then laminated on both sides to a variety of gauges of clear opticite, Dow Chemical Company (polystyrene), utilizing a layer of pressure-sensitive adhesive designated as Morton Chemical Company, Adcote 333.

Rolls of each of the laminates described in Examples 1, 2, and 3 were then taken to an off-line sheeter and sheeted. During this process, a food grade, anti-static powder was applied to the web, in order to control static through the rest of the manufacturing processes as well as in the placing machine utilized by the packager. The sheeted material was then jogged and guillotine cut into the 3.5×2.5 inch finished game cards.

The game card 13 of the present invention need not be printed on both sides. One embodiment which has been determined to be acceptable includes a core layer 15 containing a layer of printing 16 over which is disposed a layer of adhesive 18 coated with a layer of transparent, grease and moisture resistant, polymeric film 21. When the insert is printed on only one side, it is unnecessary to utilize the layer of adhesive 19 and the outer layer of polymeric film 22. Alternatively, if greater protection is desired, the core layer 15 may be printed on one side 16 or 17 and coated on both sides with respective layers of adhesive and polymeric film as at 18, 21, and 19, 22. The construction of the laminated game card prevents tampering or alteration of the indicia printed thereon, which provides added security for the game promoter. It is also within the purview of the present invention to use a plurality of game cards 13, each of which may bear certain game indicia. Such a game is played by placing all of the game cards 13 in overlying register with each other and the game board 11.

The nature of the game is designed to be extremely simple and one in which the game player can immediately determine whether the combination of the game card and the game board produces a winner. Any of a wide variety of games can be utilized incorporating the essential features of this invention including, but not limited to, game formats which indicate an object or person in motion which requires registration of one or more cards overlying said game board but not specifically requiring a grid-matrix format. The Bingo game illustrated and described herein is only one format.

To play the Bingo game disclosed herein, the purchaser of the packaged product simply opens the package 10 and removes the game card 13 which has been in contact with the food product in the package. As a result of the construction of the transparent film laminate, the printed game indicia 14 appearing on the game card have been protected from contact with the oils and greases which emanate from the food product contained in the package. Depending upon the makeup of the food product contained in the package, the most that will be required for utilization of the game card is to wipe off any residue that may have been deposited thereon.

Figure 3:
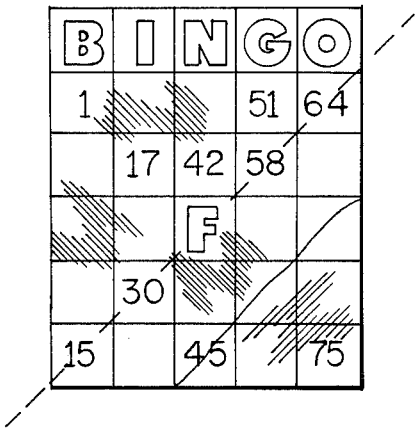
FIG. 3 is a top view showing the game card placed in overlying relationship with the game board so as to disclose a winning combination.

The game player then places the card 13 in overlying register with the game board 11 such that the upper squares of the card 13 which read "Bingo" overlie their corresponding counterparts on the game board 11. Due to the transparent nature of the card 13, the game player can then view the display which results from the combination of the card 13 and the game board 11, as best illustrated in FIG. 3. The combination shown in FIG. 3 is a winning combination, which produces a diagonal series of numbers appearing in each diagonal square as, for example, the numbers 15, 30, F, 58, and 64.

The promoter can determine, based on the circumstances of the promotion, whether, and to what extent, a winning combination will result in a prize award. In connection with most promotional games, it is required that the promoter furnish a game board and a game card free of charge. For that reason, a separate game board must be available to send to those who request it in a format other than being printed on the package, along with a game card of the type described herein. Since the indicia on all of the game boards will be the same, the game player need only present or send in the game card to redeem the prize.

The game could also be incorporated into promotions that don't end up in a package. Restaurants could print the game boards on place mats and hand out the game cards with the purchase of meals. Fast food chains could print the game boards on their packaging material and hand out the game cards with purchases.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A promotional game including a game board on which is imprinted a first set of game indicia, and at least one grease and moisture resistant game card consisting of a transparent film laminate formed of a core layer of transparent biaxially oriented polymeric film printed with a second set of game indicia particularly adapted to correspond with said first set of game indicia printed on said game board, a layer of adhesive disposed over said core layer, a layer of transparent, grease and moisture resistant, polymeric film disposed over said layer of adhesive whereby said adhesive and film layers seal and protect said second set of game indicia from contamination or alteration, said game played by placing said game card in register with, and overlying said game board such that the combined game card and game board will immediately indicate whether such combination is a game winner.

2. A promotional game as in claim 1 including a plurality of said grease and moisture resistant game cards, said game being played by placing said game cards in register with each other and overlying said game board such that the combination of said game cards and said game board will immediately indicate whether such combination is a game winner.

3. A promotional game as in claim 1 in which said game board is printed on a package for a product, and the game card is inserted into said package.

4. A promotional game as in claim 1 in which said transparent core layer is printed on one side with said second set of game indicia and is coated on both sides with said layer of adhesive and subsequently coated on both sides with said layer of transparent, grease and moisture resistant, polymeric film.

5. A promotional game as in claim 1 in which said core layer consists of clear, biaxially oriented polystyrene.

6. A promotional game as in claim 1 in which said layer of transparent, grease and moisture resistant, polymeric film consists of polypropylene.

7. A promotional game as in claim 1 in which said layer of transparent, grease and moisture resistant, polymeric film consists of polystyrene.

* * * * *